United States Patent [19]

Greaves

[11] Patent Number: 4,692,317

[45] Date of Patent: Sep. 8, 1987

[54] CORROSION CONTROL IN AQUEOUS SYSTEMS USING CATIONIC POLYMERS IN COMBINATION WITH PHOSPHONOHYDROXYACETIC ACID

[75] Inventor: Brian Greaves, Runcorn, England

[73] Assignee: W. R. Grace & Co., New York, N.Y.

[21] Appl. No.: 793,933

[22] Filed: Nov. 1, 1985

[30] Foreign Application Priority Data

Nov. 8, 1984 [GB] United Kingdom ..... 8428258

[51] Int. Cl.[4] ..... C23F 11/16

[52] U.S. Cl. ..... 422/15; 422/16; 252/180; 252/389.22; 252/389.23

[58] Field of Search ..... 252/148, 180, 389.22, 252/389.23; 422/15, 16, 13

[56] References Cited

U.S. PATENT DOCUMENTS

| | | | |
|---|---|---|---|
| 2,729,557 | 1/1956 | Booth et al. | 210/697 |
| 2,926,154 | 2/1960 | Keim | 524/607 |
| 3,036,055 | 5/1962 | Channabasappa et al. | 528/489 |
| 3,215,654 | 11/1965 | Schmalz | 524/843 |
| 3,240,664 | 3/1966 | Earle, Jr. | 162/164.3 |
| 3,311,594 | 3/1967 | Earle, Jr. | 525/430 |
| 3,332,871 | 8/1968 | Robinson | 210/697 |
| 3,462,365 | 8/1969 | Vogelsang, Jr. | 210/699 |
| 3,623,991 | 11/1971 | Sabatelli et al. | 252/180 |
| 3,639,292 | 2/1972 | Gilby | 252/179 |
| 3,658,710 | 4/1972 | Puckerius et al. . | |
| 3,752,761 | 8/1973 | Boothe et al. | 210/698 |
| 3,793,194 | 2/1974 | Zecher | 252/180 X |
| 3,837,803 | 9/1974 | Carter et al. | 422/13 |
| 3,982,894 | 9/1976 | Annand et al. | 252/148 X |
| 4,038,451 | 7/1977 | Brown et al. | 428/274 |
| 4,042,324 | 8/1977 | Auel et al. | 252/389.23 X |
| 4,052,160 | 10/1977 | Cook et al. | 422/15 |
| 4,057,511 | 11/1977 | Bohnsack et al. | 252/389.23 |
| 4,085,060 | 4/1978 | Vassileff | 252/180 |
| 4,297,237 | 10/1981 | Boffardi | 252/389.2 |
| 4,323,461 | 4/1982 | Quinlan | 210/700 |
| 4,387,027 | 6/1983 | May et al. | 210/697 |
| 4,557,896 | 12/1985 | Brocklebank et al. | 422/14 |

FOREIGN PATENT DOCUMENTS

| | | | |
|---|---|---|---|
| 0075514 | 9/1982 | European Pat. Off. | 252/180 |
| 2505435 | 8/1976 | Fed. Rep. of Germany | 252/389.23 |
| 1208827 | 10/1970 | United Kingdom | 422/16 |
| 1297515 | 11/1972 | United Kingdom | 252/181 |
| 1348595 | 3/1974 | United Kingdom | 252/389.2 |
| 1452557 | 10/1976 | United Kingdom | 252/389.23 |
| 1486396 | 9/1977 | United Kingdom | 252/392 |
| 1520915 | 8/1978 | United Kingdom | 252/389.22 |
| 1539974 | 2/1979 | United Kingdom | 252/389.23 |
| 1589109 | 5/1981 | United Kingdom | 252/180 |
| 2066234 | 7/1981 | United Kingdom | 252/389.2 |
| 2085433A | 4/1982 | United Kingdom | 252/344 |
| 2105319 | 3/1983 | United Kingdom | 252/180 |
| 2112370 | 7/1983 | United Kingdom | 252/389.23 |

OTHER PUBLICATIONS

"Betz Handbook of Industrial Water Conditioning", Seventh Edition, 1976, pp. 198–200.

Patent Abstracts of Japan, unexamined Applications, C Field, vol. 8, No. 184, p. 35 C 239, Aug. 23, 1984.

Research Disclosure 23229; Ciba-Geigy PLC; "Inhibiting Corrosion and Scale Deposition", Aug. 1983.

*Primary Examiner*—Matthew A. Thexton

*Attorney, Agent, or Firm*—David E. Heiser

[57] ABSTRACT

A method for inhibiting corrosion in an aqueous system, for example a cooling system, is disclosed which comprises adding to the system a phosphonate of the formula:

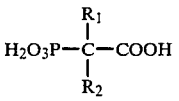

where $R_1$ represents hydrogen or an alkyl radical of 1 to 6 carbon atoms and $R_2$ represents hydrogen, hydroxyl or amino, or a salt thereof and a cationic polymer.

42 Claims, No Drawings

CORROSION CONTROL IN AQUEOUS SYSTEMS USING CATIONIC POLYMERS IN COMBINATION WITH PHOSPHONOHYDROXYACETIC ACID

This invention relates to the inhibition of corrosion in aqueous systems, especially in cooling water systems and their associated equipment.

A variety of different anions have been used to inhibit corrosion. These include inorganic phosphates, nitrites and chromates. The effectiveness of these various anions is not, of course, the same and although they are reasonably effective they all possess one or more drawbacks.

In particular, the use of orthophosphate is well established. However, in order for the orthophosphate to be effective in the particular aqueous system, it is quite frequently necessary to use concentrations of orthophosphate greater than 10 ppm. However, the use of these higher concentrations of orthophosphate, in particular, makes it necessary to work in the presence of highly effective anionic dispersants in order to prevent calcium phosphate from fouling the heat exchangers and pipework in the system. The calcium phosphate suspended in the water in this way does not contribute towards corrosion inhibition and can, in fact, cause corrosion because if it is allowed to settle out on ferrous metal parts of the system, corrosion can form underneath the resulting deposits and these are, of course, less accessible to the corrosion inhibitor. These problems are particularly severe with high pH or hardness values.

Sodium nitrite is also well known as a corrosion inhibitor but it is normally necessary to use it in concentrations of 500–1000 ppm. At these levels the use of nitrite is environmentally unacceptable. Accordingly, therefore, it is not generally possible to use sodium nitrite in spite of its effectiveness.

It is also well known that the use of chromate, particularly when used in combination with zinc salts, provides excellent corrosion protection in aqueous systems. Once again, however, the use of hexavalent chromium salts at concentrations of 15 ppm or more is environmentally unacceptable for toxicity reasons. This has, therefore, considerably curtailed the use of chromate for this purpose.

Zinc salts are also effective but they, too, give rise to problems arising from the precipitation of insoluble zinc hydroxide.

Phosphonates do not, in general, suffer from the disadvantages of these inorganic salts but they are expensive.

It has now been found, according to the present invention, that the amount of certain phosphonates effective to inhibit corrosion can be reduced significantly if they are used in combination with a cationic polymer. It is believed that these specific phosphonates form a passivating or protective film, predominantly at the anode, thus creating conditions which are conducive to the formation of an oxide film although this does not form part of the present invention. It has been found that a useful synergistic effect can be obtained with the result that a composition which is effective in inhibiting corrosion can be provided which contains much smaller amounts of the expensive phosphonate; the phosphonate will typically be at least three times as expensive as the polymer. Accordingly, the present invention provides a method for inhibiting corrosion in an aqueous system which comprises adding to the system a phosphonate of the formula:

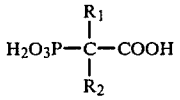

where $R_1$ represents hydrogen or an alkyl radical of 1 to 6 carbon atoms and $R_2$ represents hydrogen, hydroxyl or amino, or a salt thereof and a cationic polymer. The salts used are typically water soluble salts, especially alkali metal, in particular sodium or potassium, salts. Ammonium salts are generally not to be recommended as they may promote attack on yellow metals such as copper or brass. A preferred phosphonate is phosphonohydroxyacetic acid i.e. $R_1$ is hydrogen and $R_2$ is hydroxyl. The precise nature of the cationic polymer is unimportant. In general, by using the specified cationic polymers it is possible to use less than 10 ppm of the specified phosphonate and, indeed, amounts of say 7.5 ppm phosphonate together with 2.5 ppm of polymer is much more effective than the use of 10 ppm of phosphonate by itself.

A considerable variety of different polymers can be used provided that they are cationic; preferably they are substantially linear i.e. polymers which have substantially no crosslinking but which may contain, for example cyclic groups in a substantially linear chain. Although it is possible to use, for instance, polyethyleneimines, especially low molecular weight polyethyleneimines, for example a molecular weight up to 5,000 and especially up to 2,000 including tetraethylene pentamine and triethylene tetramine, it is generally preferred to use protonated or quaternary ammonium polymers. These quaternary ammonium polymers are preferably derived from ethylenically unsaturated monomers containing a quaternary ammonium group or are obtained by reaction between a polyalkylene polyamine and epichlorohydrin, or by reaction between epichlorhydrin dimethylamine and either ethylene diamine or polyalkylene polyamine.

Typical cationic polymers which can be used in the present invention and which are derived from an ethylenically unsaturated monomer include homo- and copolymers of vinyl compounds such as (a) vinyl pyridine and vinyl imidazole which may be quaternised with, say, a $C_1$ to $C_{18}$ alkyl halide, a benzyl halide, especially a chloride, or dimethyl or diethyl sulphate, or (b) vinyl benzyl chloride which may be quaternised with, say, a tertiary amine of formula $NR_1R_2R_3$ in which $R_1R_2$ and $R_3$ are independently lower alkyl, typically of 1 to 4 carbon atoms, such that one of $R_1R_2$ and $R_3$ can be $C_1$ to $C_{18}$ alkyl; allyl compounds such as diallyldimethyl ammonium chloride; or acrylic derivatives such as (i) a dialkyl aminomethyl(meth)acrylamide which may be quaternised with, say, a $C_1$ to $C_{18}$ alkyl halide, a benzyl halide or dimethyl or diethyl sulphate, (ii) a methacrylamido propyl tri($C_1$ to $C_4$ alkyl, especially methyl) ammonium salt, or (iii) a (meth)acryloyloxyethyl tri($C_1$ to $C_4$ alkyl, especially methyl) ammonium salt, said salt (ii) or (iii) being a halide, especially a chloride, methosulphate, ethosulphate or 1/n of an n-valent anion. These monomers may be copolymerised with a (meth)acrylic derivative such as acrylamide, an acrylate or methacrylate $C_1$–$C_{18}$ alkyl ester or acrylonitrile. Typical such polymers contain 10–100 mol % of recurring units of the formula:

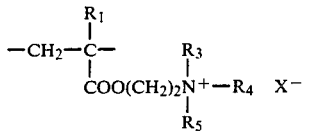

and 0–90 mol % of recurring units of the formula:

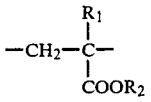

in which $R_1$ represents hydrogen or a lower alkyl radical, typically of 1–4 carbon atoms, $R_2$ represents a long chain alkyl group, typically of 8 to 18 carbon atoms, $R_3$, $R_4$ and $R_5$ independently represent hydrogen or a lower alkyl group while X represents an anion, typically a halide ion, a methosulfate ion, an ethosulfate ion or 1/n of a n valent anion.

Other quaternary ammonium polymers derived from an unsaturated monomer include the homo-polymer of diallyldimethylammonium chloride which possesses recurring units of the formula:

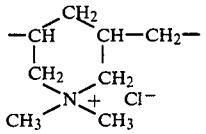

In this respect, it should be noted that this polymer should be regarded as "substantially linear" since although it contains cyclic groupings these groupings are connected along a linear chain and there is no crosslinking.

Other polymers which can be used and which are derived from unsaturated monomers include those having the formula:

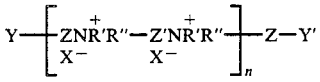

where Z and Z' which may be the same or different is $—CH_2CH{=}CHCH_2—$ or $—CH_2—CHOHCH_2—$, Y and Y', which may be the same or different, are either X or —NH'R", X is a halogen of atomic weight greater than 30, n is an integer of from 2 to 20, and R' and R" (I) may be the same or different alkyl groups of from 1 to 18 carbon atoms optionally substituted by 1 to 2 hydroxyl groups; or (II) when taken together with N represent a saturated or unsaturated ring of from 5 to 7 atoms; or (III) when taken together with N and an oxygen atom represent the N-morpholino group, which are described in U.S. Pat. No. 4,397,743. A particularly preferred such polymer is poly(dimethylbutenyl) ammonium chloride bis-(triethanol ammonium chloride).

Another class of polymer which can be used and which is derived from ethylenically unsaturated monomers includes polybutadienes which have been reacted with a lower alkyl amine and some of the resulting dialkyl amino groups are quaternised. In general, therefore, the polymer will possess recurring units of the formula:

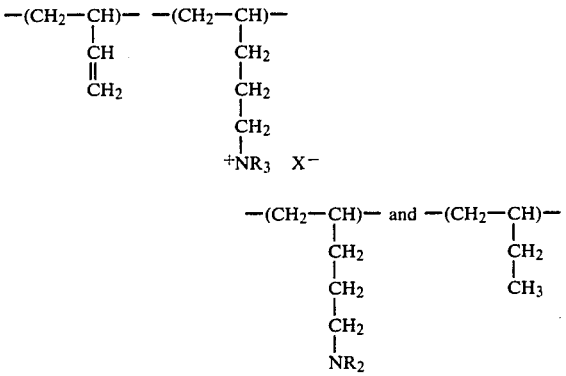

in the molar proportions $a:b_1:b_2:c$, respectively, where R represents a lower alkyl radical, typically a methyl or ethyl radical. It should be understood that the lower alkyl radicals need not all be the same. Typical quaternising agents include methyl chloride, dimethyl sulfate and diethyl sulfate. Varying ratios of $a:b_1:b_2:c$ may be used with the amine amounts $(b_1+b_2)$ being generally from 10–90% with $(a+c)$ being from 90%–10%. These polymers can be obtained by reacting polybutadiene with carbon monoxide and hydrogen in the presence of an appropriate lower alkyl amine.

Of the quaternary ammonium polymers which are derived from epichlorohydrin and various amines, particular reference should be made to the polymers described in British Specification Nos. 2085433 and 1486396. A typical amine which can be employed is N,N,N',N'-tetramethylethylenediamine as well as ethylenediamine used together with dimethylamine and triethanolamine. Particularly preferred polymers of this type for use in the present invention are those having the formula:

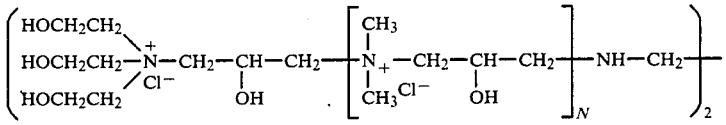

where N is from 0–500, although, of course, other amines can be employed.

Reference should be made to the above British Patent Specifications for further details.

Other polymers which can be used include protonated polymers such as polymers corresponding to the above quaternary ammonium polymers where the amine groups are not quaternised but are neutralised with acid, such as hydrochloric acid, as well as cationic tannin derivatives, such as those obtained by a Mannich-type reaction of tannin (a condensed polyphenolic body) with formaldehyde and an amine, formed as a salt e.g. acetate, formate, hydrochloride. These cationic tannin derivatives can also be quaternised. Further polymers which can be used include the polyamine polymers which have been crosslinked such as polyamideamine/polyethylene polyamine copolymers crosslinked with, say, epichlorohydrin.

The molecular weight of the polymers used can vary within broad limits, say from 250–10 million in some cases although, in general, the molecular weights will range from 250–1 million, especially 400–10,000.

The amounts of the components used do, of course, depend, to some extent, on the severity of the corrosion conditions but, of course, corrosion inhibiting amounts are desirable. In general, however, from 1–50 ppm, especially from 1–10 ppm, of each will be used and the relative amounts of the two components will generally vary from 1:10 to 10:1 by weight, in particular with a polymer:salt ratio from 1:8 to 2:1 by weight, especially with the polymer concentration being lower than that of the salt, preferably with the polymer:salt weight ratio being from 1:1.5 to 1:6.

Although the components can be added to the system separately it will generally be more convenient to add them together as a single composition. Accordingly, the present invention also provides a composition suitable for addition to an aqueous system which comprises a cationic polymer and a phosphonate having the formula set out above, or a salt thereof.

The compositions of the present invention will normally be in the form of an aqueous solution containing, in general, from 1–25% by weight active ingredient (solids). A common concentration is from 5–10% by weight.

The additives used in the present invention can be used, sometimes advantageously, together with other water treatment additives such as inorganic salts such as phosphates, especially disodium and trisodium orthophosphate, nitrites, especially sodium nitrite, and chromates, especially potassium chromate, as well as zinc salts such as zinc sulphate, other phosphonates such as pentaphosphonomethylene substituted diethylenetriamine and especially phosphonates which contain 3 acid groups which are carboxylic and phosphonic acid groups at least one of which is a phosphonic acid group and at least one of which is a carboxylic acid group, at least the said 3 acid groups being attached to carbon atoms, such as 2-phosphono-butane-1,2,4-tricarboxylic acid, nitrilo tris (methylene phosphonic acid) and hydroxyethylidene diphosphonic acid. The addition of phosphates or nitrite, in particular, enables one to use smaller quantities of phosphate. Further, presence of small amounts of phosphate or nitrite enhances the effectiveness of the polymer/phosphonate in low hardness water where its effectiveness is less. In general the weight ratio of polymer:phosphate is from 1:10 to 10:1, in particular from 1:8 to 2:1 and preferably from 1:1.5 to 1:6. The weight ratio of polymer:nitrite is generally from 1:1 to 1:50, in particular from 1:2 to 1:10 and preferably from 1:2 to 1:6.

When this additional salt is present it should be taken into account when determining the polymer:phosphonate ratio. Thus the preferred polymer:phosphonate and additional salt weight ratio is 1:1.5 to 1:6.

Other additives which can be present include dispersants such as sulphonated and carboxylated polymers, especially copolymers of maleic acid and sulphonate styrene or of methacrylic acid and 2-acrylamido-2-methyl propane sulphonic acid, azoles such as benzotriazole and biocides such as isothiazolones, methylene bis (thiocyanate), quaternary ammonium compounds and chlorine release agents. In fact certain of the cationic polymers possess biocidal properties thereby enhancing the effect of the biocides.

The following Examples further illustrate the present invention.

EXAMPLES 1–10

These examples were carried out on a laboratory recirculating rig using a synthetic water possessing 150 ppm calcium hardness and 150 ppm "M" alkalinity (both calculated as calcium carbonate) and pH of 8.7. The temperature of the water was maintained at 130° F. and the rig was first passivated for one day at three times the normal dose level to form a passivating film. The test lasted three days using a flow rate of 2 ft. per second in line and 0,2 ft per second in the tank. Mild steel test coupons were placed in the line and in the tank, corrosion rates being calculated from the weight loss of the coupons during the experiment.

In these Examples, phosphonate 1 was phosphonohydroxyacetic acid and polymer 1 was a quaternary ammonium compound formed from epichlorohydrin, ethylenediamine, dimethylamine and triethanolamine obtained according to the procedure described in British specification No. 2085433, having molecular weight of 5,000–6,000. The results obtained are shown in the following table:

| Example No. | Additive | Dose, ppm | Corrosion Rate mils per year Mild Steel (Line) | Mild Steel (Tank) |
|---|---|---|---|---|
| 1 | No Treatment | — | 40.5 | 48.0 |
| 2 | Polymer 1 | 10 | 50.6 | 64.8 |
| 3 | Phosphonate 1 | 10 | 14.1 | 10.5 |
| 4 | Polymer 1/Phosphonate 1 | 2.5/10 | 0.7 | 2.6 |
| 5 | Polymer 1/Phosphonate 1 | 0.5/9.5 | 9.4 | 10.6 |
| 6 | Polymer 1/Phosphonate 1 | 1.5/8.5 | 1.6 | 1.7 |
| 7 | Polymer 1/Phosphonate 1 | 2.5/7.5 | 2.2 | 5.1 |
| 8 | Polymer 1/Phosphonate 1 | 3.5/6.5 | 3.1 | 6.7 |
| 9 | Polymer 1/Phosphonate 1 | 5/5 | 7.4 | 20.4 |
| 10 | Polymer 1/Phosphonate 1 | 7.5/2.5 | 16.5 | 30.3 |

Examples 5–10 when compared with Examples 2 and 3 demonstrate the synergistic effect obtained using the phosphonate in conjunction with the cationic polymer in the prevention of corrosion of mild steel.

EXAMPLES 11–13

The following tests were carried out as in Examples 1–10:

| Example | Additive | Dose, ppm | Corrosion Rate mpy Mild Steel (Line) | Mild Steel (Pond) |
|---|---|---|---|---|
| 11 | Polymer 1/Phosphonate 1/ disodium o-Phosphate | 5/6/3 | 0.1 | 0.2 |
| 12 | Polymer 1/Phosphonate 1/ — | 5/6/— | 6.5 | 10.1 |
| 13 | —/—/ o-Phosphate | —/—/3 | 28.5 | 24.3 |

It is evident that the 3 component system is a very effective corrosion inhibitor.

EXAMPLES 14–17

The following tests were carried out as in Examples 1–10 except that the water quality was varied as shown below:

| Example | Additive | Dose, ppm | Water Quality Calcium Hardness ppm/'M' Alkalinity, ppm | Corrosion Rate mpy (Line) | Corrosion Rate mpy (Pond) |
|---|---|---|---|---|---|
| 14 | Polymer 1/ Phosphonate 1/Nitrite | 2.5/10/10 | 50/50 | 0.4 | 0.2 |
| 15 | Polymer 1/ Phosphonate 1/Nitrite | 2.5/10/— | 50/50 | 1.1 | 1.2 |
| 16 | Polymer 1/ Phosphonate 1/Nitrite | 2.5/10/10 | 25/25 | 0.5 | 0.3 |
| 17 | Polymer 1/ Phosphonate 1/Nitrite | 2.5/10/— | 25/25 | 1.9 | 2.4 |

These results show the excellent corrosion inhibition which is attainable using the 3 component system which involves very low nitrite concentrations thus lowering the toxicity due to the nitrite component to a very low level.

I claim:

1. A method for inhibiting corrosion of steel and the like in an aqueous system which comprises adding to the system phosphonohydroxyacetic acid or a salt thereof and a cationic polymer having a molecular weight between about 400 and about 10,000; said cationic polymer being selected from the group consisting of (a) polymers derived by polymerizing ethylenically unsaturated monomers and incorporating quaternary ammonium groups or protonated amine groups therein, and (b) polymers containing quaternary ammonium groups or protonated amine groups and derived from reacting epichlorohydrin with amines; and the cationic polymer component being added to the system in a weight ratio to the phosphonohydroxyacetic acid component in the system of between about 1:8 and about 2:1.

2. A method according to claim 1 in which the salt is an alkali metal salt.

3. A method according to claim 1 in which the phosphonate is phosphonohydroxyacetic acid.

4. A method according to claim 1 in which the polymer is substantially linear.

5. A method according to claim 1 in which the polymer is a quaternary ammonium polymer.

6. A method according to claim 5 in which the polymer is one derived from an ethylenically unsaturated monomer containing a quaternary ammonium group or one obtained by a reaction between a polyalkylene polyamine and epichlorohydrin or by reaction between epichlorohydrin, dimethylamine and ethylene diamine or a polyalkylene polyamine.

7. A method according to claim 5 in which the cationic polymer is derived from vinyl pyridine, vinyl imidazole, or an acrylic derivative which is quaternised with $C_1$ to $C_{18}$ alkyl halide, a benzyl halide, or dimethyl or diethyl sulphate; or is derived from a vinyl benzyl chloride which is quaternised with a tertiary amine; or is derived from an allyl compound.

8. A method according to claim 5 in which the cationic polymer contains 10 to 100 mol% of recurring units of the formula:

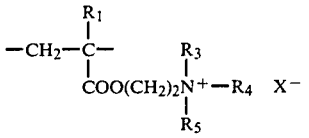

and 0–90 mol% of recurring units of the formula:

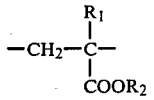

in which $R_1$ represents hydrogen or a lower alkyl radical, $R_2$ represents a long chain alkyl group having 8 to 18 carbons, $R_3$, $R_4$ and $R_5$ independently represent hydrogen or a lower alkyl group while X represents an anion.

9. A method according to claim 5 in which the polymer possesses recurring units of the formula:

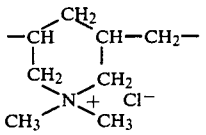

10. A method according to claim 5 in which the cationic polymer is derived from an unsaturated polymer having the formula:

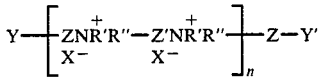

where Z and Z', which may be the same or different, is $-CH_2CH{=}CHCH_2-$ or $-CH_2-CHOHCH_2-$, Y and Y', which may be the same or different, are either X or —NH'R", X is a halogen of atomic weight greater than 30, n is an integer of from 2 to 20, and R' and R" (I) may be the same or different alkyl groups of from 1 to 18 carbon atoms optionally substituted by 1 to 2 hydroxyl groups; or (II) when taken together with N represent a saturated or unsaturated ring of from 5 to 7 atoms; or (III) when taken together with N and an oxygen atom represent the N-morpholino group.

11. A method according to claim 5 in which the cationic polymer is poly(dimethylbutenyl) ammonium chloride bis-(triethanol ammonium chloride).

12. A method according to claim 5 in which the cationic polymer possesses recurring units of:

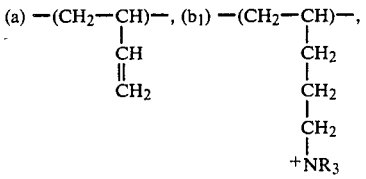

-continued

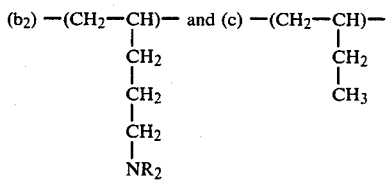

in the molar proportions $a:b_1:b_2:c$ respectively, where each R independently represents a lower alkyl radical and where $(b_1+b_2)$ is from about 10 to about 90 percent of said recurring units, and $(a+c)$ is from about 90 to about 10 percent of said recurring units.

13. A method according to claim 5 in which the cationic polymer has the formula:

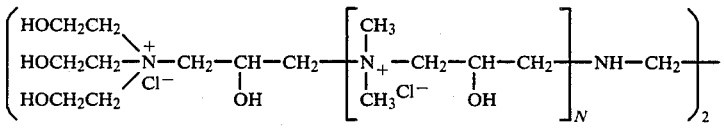

where N is from 0–500.

14. A method according to claim 5 in which the cationic polymer is a substantially linear polymer derived from reacting epichlorohydrin with amines selected from the group consisting of dimethylamine, triethanolamine, ethylene diamine, and polyalkylene polyamines.

15. A method according to claim 1 in which the cationic polymer is a quaternary ammonium compound obtained by reacting epichlorohydrin with ethylene diamine, dimethylamine and triethanolamine.

16. A method according to claim 1 in which the cationic polymer and salts are each present in an amount from about 1 to 50 ppm.

17. A method according to claim 16 in which the cationic polymer and salts are each present in an amount from about 1 to 10 ppm.

18. A method according to claim 1 in which a phosphate or nitrite is also added to the system.

19. A method according to claim 1 in which the concentration of polymer is less than that of the salt.

20. A method according to claim 19 in which the weight ratio of polymer:phosphonate is from about 1:1.5 to 1:6.

21. A method according to claim 1 in which the aqueous system is a cooling system.

22. A composition suitable for addition to an aqueous system which comprises phosphonohydroxyacetic acid or a salt thereof and a cationic polymer having a molecular weight between about 400 and about 10,000; said cationic polymer being selected from the group consisting of (a) polymers derived by polymerizing ethylenically unsaturated monomers and incorporating quaternary ammonium groups or protonated amine groups therein, and (b) polymers containing quaternary ammonium groups or protonated amine groups and derived by reacting epichlorohydrin with amines; and the weight ratio of the cationic polymer component to the phosphonohydroxyacetic acid component being between about 1:8 and about 2:1.

23. A composition according to claim 22 which is in the form of an aqueous solution.

24. A composition according to claim 22 in which the active ingredients (solid) are present in an amount from 1 to 25% by weight.

25. A composition according to claim 22 in which the salt is an alkali metal salt.

26. A composition according to claim 22 in which the salt is phosphonohydroxyacetic acid.

27. A composition according to claim 22 in which the polymer is substantially linear.

28. A composition according to claim 22 in which the polymer is a quaternary ammonium polymer.

29. A composition according to claim 28 in which the polymer is one derived from an ethylenically unsaturated monomer containing a quaternary ammonium group or one obtained by a reaction between a polyalkylene and epichlorohydrin or by reaction between epichlorohydrin, dimethylamine and ethylene diamine or a polyalkylene polyamine.

30. A composition according to claim 28 in which the cationic polymer is derived from vinyl pyridine, vinyl imidazole, or an acrylic derivative which is quaternised with $C_1$ to $C_{18}$ alkyl halide, a benzyl halide, or dimethyl or diethyl sulphate; or is derived from a vinyl benzyl chloride which is quaternised with a tertiary amine; or is derived from an allyl compound.

31. A composition according to claim 28 in which the cationic polymer contains 10 to 100 mol% of recurring units of the formula:

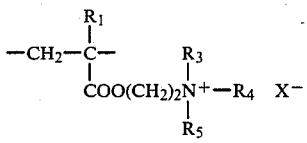

and 0–90 mol% of recurring units of the formula:

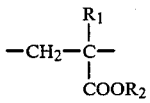

in which $R_1$ represents hydrogen or a lower alkyl radical, $R_2$ represents a long chain alkyl group having 8 to 18 carbons, $R_3$, $R_4$ and $R_5$ independently represent hydrogen or a lower alkyl group while X represents an anion.

32. A composition according to claim 28 in which the polymer possesses recurring units of the formula:

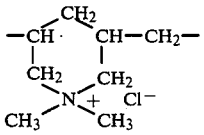

33. A composition according to claim 28 in which the cationic polymer is derived from an unsaturated polymer having the formula:

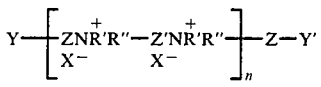

where Z and Z', which may be the same or different, is $-CH_2CH{=}CHCH_2-$ or $-CH_2-CHOHCH_2-$, Y and Y', which may be the same or different, are either X or $-NH'R''$, X is a halogen of atomic weight greater than 30, n is an integer of from 2 to 20, and R' (I) may be the same or different alkyl groups of from 1 to 18 carbon atoms optionally substituted by 1 to 2 hydroxyl groups; or (II) when taken together with N represent a saturated or unsaturated ring of from 5 to 7 atoms; or (III) when taken together with N and an oxygen atom represent the N-morpholino group.

34. A composition according to claim 28 in which the cationic polymer is poly(dimethylbutenyl) ammonium chloride bis-(triethanol ammonium chloride).

35. A composition according to claim 28 in which the cationic polymer possesses recurring units of:

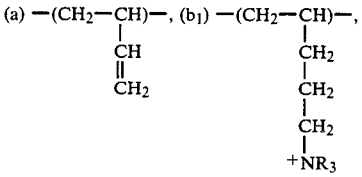

-continued

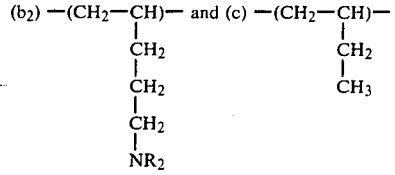

in the molar proportions $a:b_1:b_2:c$ respectively, where each R independently represents methyl or ethyl, and where $(b_1+b_2)$ is from about 10 to about 90 percent of said recurring units and $(a+c)$ is from about 90 to about 10 percent of said recurring units.

36. A composition according to claim 28 in which the cationic polymer has the formula:

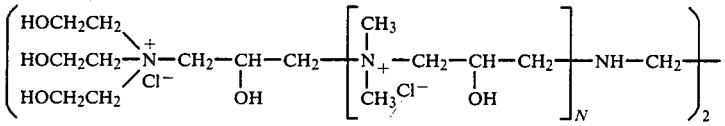

where N is from 0–500.

37. A composition according to claim 28 in which the cationic polymer is a substantially linear polymer derived from reacting epichlorohydrin with amines selected from the group consisting of dimethylamine, triethanolamine, ethylene diamine, and polyalkylene polyamines.

38. A composition according to claim 37 in which the amines reacted to obtain the polymer include ethylene diamine and triethanolamine.

39. A composition according to claim 22 which also contains a phosphate or a nitrite.

40. A composition according to claim 22 in which the cationic polymer is a quaternary ammonium compound obtained by reacting epichlorohydrin with ethylene diamine, dimethylamine, and triethanolamine.

41. A composition according to claim 22 in which the concentration of polymer is less than that of the salt.

42. A composition according to claim 41 in which the weight ratio of polymer:phosphonate is from about 1:1.5 to 1:6.

* * * * *